United States Patent [19]

Colvin et al.

[11] Patent Number: 4,869,398

[45] Date of Patent: Sep. 26, 1989

[54] LIQUID CONTAINER DELIVERY AND STORAGE SYSTEM

[75] Inventors: Arthur E. Colvin, Mt. Airey; Matthew W. Hanley, Gaithersburg; Richard C. Hetrick, Darnestown, all of Md.

[73] Assignee: Life Technologies, Inc., Gaithersburg, Md.

[21] Appl. No.: 147,209

[22] Filed: Jan. 15, 1988

Related U.S. Application Data

[63] Continuation of Ser. No. 934,710, Nov. 25, 1986, abandoned.

[51] Int. Cl.[4] ..... B65D 35/56

[52] U.S. Cl. ..... 222/83; 222/94; 222/105; 604/404; 604/408

[58] Field of Search ..... 229/52 A; 604/404, 408, 604/414; 222/81, 83, 83.5, 85–86, 105, 131, 143, 152, 181, 481–482, 92, 94

[56] References Cited

U.S. PATENT DOCUMENTS

| | | | |
|---|---|---|---|
| 3,265,254 | 8/1966 | Carter et al. | 222/143 X |
| 3,430,815 | 3/1969 | Weimer et al. | 222/105 X |
| 3,902,489 | 9/1975 | Carter | 222/83 X |
| 3,908,864 | 9/1975 | Capper | 222/105 X |
| 3,976,228 | 8/1976 | Robbins | 222/143 |
| 4,167,242 | 9/1979 | Kupersmit | 229/52 A X |
| 4,174,051 | 11/1979 | Edwards et al. | 222/105 |
| 4,236,664 | 12/1980 | Hartelmuller | 229/52 A X |
| 4,337,769 | 7/1982 | Olson | 604/408 X |
| 4,411,358 | 10/1983 | Bennwik et al. | 604/404 X |
| 4,629,080 | 12/1986 | Carveth | 604/408 X |
| 4,655,763 | 4/1987 | Malcolm et al. | 604/404 |
| 4,657,540 | 4/1987 | Iwamoto et al. | 604/408 |

FOREIGN PATENT DOCUMENTS

| | | | |
|---|---|---|---|
| 2615062 | 10/1977 | Fed. Rep. of Germany | 604/404 |
| 2020253 | 11/1979 | United Kingdom | 222/83 |

OTHER PUBLICATIONS

Letter from E. Scanlin of Tissue Culture Innovations (Tabruco Canyon, Calif.) to N. Sandford of GIBCO (Grand Island, N.Y.) dated Mar. 12, 1966 (2 pp.).

Letter with Enclosure from R. Roberts to New Port Bio Systems (Menlo Park, Calif.) apparently to GIBCO, stamped received Aug. 28, 1986 (total 4 pp.).

Letter and Enclosure from R. Roberts, Associated with Media Innovations of Menlo Park, Calif. to Carl apparently of GIBCO, stamped received Oct. 8, 1986 (total 2 pp.).

Advertising Brochure from Scientific Technologies of Raleigh, N.C., pre-dating Apr. 15, 1987, apparently Marketing Tissue Culture Innovations' Media Bag (4 pp.).

Memorandum to K. Wright from J. Commons re Tissue Culture Innovations/New Port Bio Systems, describing product marketing by same, dated Jun. 5, 1986.

*Primary Examiner*—Michael S. Huppert

*Attorney, Agent, or Firm*—Saidman, Sterne, Kessler & Goldstein

[57] ABSTRACT

A liquid container is packaged in a box having a removable handle which also acts as a closure device for the opening and closing of the box. The liquid may be bulk sterile fluids, chromatography buffers, industrial enzymes packaged in glycerol, liquid nutrient solutions, and similar liquids. The container comprises an inner bladder made of polyvinyl chloride. The inner bladder is wrapped in a carbon dioxide/oxygen gas barrier. This gas barrier may be in the form of a plastic bag. The gas barrier reduces or prevents the deterioration of the liquid in the inner bladder. The inner bladder has three ports for accessing the liquid. These ports are of a septum-type which can indicate tapering, The inner bladder also has a fill tube for use in filling, and a metal hook for hanging if the inner bladder, is removed from the box. The box is designed to support weight sufficient to allow stacking of several boxes with associated filled inner bladders. The box also has perforated cutouts to allow viewing of the liquid and its color and to provide access to the ports of the inner bladder stored in the box. A color indicator may be added to the liquid for indicating its usability.

3 Claims, 5 Drawing Sheets

LIQUID CONTAINER DELIVERY AND STORAGE SYSTEM

This application is a continuation of application Ser. No. 934,710, filed 11/25/86, abandoned.

BACKGROUND OF THE INVENTION

1. Field of the Invention

This invention pertains to storage systems for liquid, and more particularly, to such storage systems which produce functional and efficient dispensing, preserving and handling of the liquid.

2. Related Art

The related art known to the inventors pertains to storage apparatus for liquid tissue culture media. This liquid may also be known as aqueous nutrient solution or liquid media. The application area for liquid media concerns the growing of microorganisms in a laboratory or industrial setting. The current technology includes a polyvinyl chloride (PVC) bladder used for the storage, shipping, and handling of the liquid media. Representative of the current technology is the unit distributed by Tissue Culture Innovations (TCI) of Trabuco Canyon, Calif., for the storage of liquid tissue culture media. Tissue Culture Innovations currently sells liquid media in PVC bladders ranging from one liter to fifty liters. Various aspects of this particular PVC storage device will be discussed in the remainder of this section.

An important aspect of this example of the related art involves the deterioration of the contained media. The inventors discovered that liquid media exhibited rapid deterioration due to a carbon dioxide and oxygen gas exchange between the stored media and the external environment. The inventors have found that the conventional PVC bladder allows oxygen and/or carbon dioxide to pass through the walls of the bladder which reacts with the contained liquid media, thereby causing its deterioration and unuseability.

Another aspect of the TCI conventional PVC bladder concerns the dispensing of the liquid media from the storage bladder. The current TCI bladder provides a six inch PVC hose for filling and dispensing of the contained liquid media. This dual purpose hose is fitted with a reusable cap to be placed at the end of the hose. The flow of liquid media through the hose is controlled by a clamp which is placed on the hose to constrict it to closure.

Another aspect concerns the storage capacity of the conventional PVC bladder. In many applications, it may be desirable to have a continuous supply of liquid media. The dispensing hose of the TCI bladder provides no convenient method for interconnection with other bladders. It may be convenient, for example, to be able to serially interconnect several of the supply bladders to provide a continuous flow of liquid media, but this is not possible with conventional products.

Another aspect of the dispensing technique employed by the conventional bladders involves the ability to detect tampering of the contained liquid media. The reusable cap and clamp placed on the dispensing hose provide no means in which to detect whether the contained liquid media has been tampered with. Nor does the reusable cap and clamp provide a means to ensure the sterility of the contained liquid media.

Shipping and handling of the conventional bladder is also a problem. The conventional bladder is not easily handled. The current technology provides no convenient method for lifting and carrying the liquid media bladder. Efficient storage of the bladder is another problem with the conventional product. It may be desirous, for example, to be able to stack the bladder or hang it for storage or in dispensing applications, but this is not possible with the conventional technology.

BRIEF SUMMARY OF THE INVENTION

The present invention relates to a method and apparatus for storing liquid using a PVC bladder. Many types of liquids may be stored in the present invention, including but not limited to sterile fluids used in clinical applications, enzymes packaged in glycerol for industrial processing applications, glucose solutions, sterile sugar solutions, protein solutions, blood, and aqueous nutrient solutions for biological applications. The current embodiment of the present invention relates to a method and apparatus for storing an aqueous nutrient solution for biological applications. It should be understood that the principles and ideas behind the present invention can be applied to any fluid of the type previously mentioned where the important considerations involve sterility, ease of shipping, handling, storage, dispensing, and/or deterioration due to gaseous permeation of the container walls.

The inner bladder of the current embodiment of the present invention is formed of polyvinyl chloride. It may contain an approximate volume of any size, such as 10 liters. The bladder is formed of two flat sheets of PVC heat sealed at their edges. The bladder is filled through a ½ inch inside diameter filling tube three inches in length. The liquid material to be contained is injected into the bladder through this fill tube which is then heat sealed. It should be understood that any suitable method of sealing the filing tube may be considered.

The present invention provides at least one port, the preferred embodiment comprises three ports, for dispensing of the contained liquid from the inner bladder. The dispensing ports are of the septum type, which are designed to be punctured by a spike entering the port. The septum type ports serve a dual purpose in the present invention. They act to ensure the sterility of the contained liquid, and provide a means to detect tampering with the contained liquid through the dispensing ports.

Another important aspect of the present invention concerns the dispensing tubes and interconnection scheme. The kit of the present invention includes a six-inch dispensing tube with plastic spikes at each end for the interconnection of two closely-located bladders. The present invention kit further includes an interconnection tube ⅛ inch inside diameter in which the plastic spikes are designed to mate with the dispensing ports of the inner bladder and pierce the septums contained therein. The plastic spikes at the end of the dispensing tube are covered with a white plastic cap for protection and sterility purposes.

The three ports in the preferred embodiment allow for a serial interconnection scheme of any number of inner bladders. The serial interconnection scheme operates as follows: one dispensing port of the inner bladder is used as an inlet from the preceding bladder in the serial chain; another dispensing port is used as the outlet to the next inner bladder in the serial chain; and the third dispensing port may be used as an extra or to inject any supplemental fluid into the inner bladder.

Another important aspect of the present invention relates to the orientation of the inner bladder during dispensing. The preferred embodiment of the inner bladder comprises a hanging bar, which is heat-sealed into the end of the bladder opposite the three dispensing ports. The hanging bar consists of a metal rod with a hook in the middle. In laboratory applications it may be convenient to hang the inner bladder to take advantage of a gravity feed system to deliver the contained liquid to the point of delivery. The inner bladder may also be laid flat during the dispensing of the contained liquid.

Another aspect of the present invention involves the gas barrier which encloses the inner bladder. The purpose of the barrier is to block or slow the exposure of the contained liquid to carbon dioxide and oxygen gas. In the specific application of the preferred embodiment, the contained aqueous nutrient solution, or "liquid media," deteriorates with exposure to carbon dioxide and oxygen gases. Without this gas barrier, these gases will permeate the walls of the PVC inner bladder and cause the deterioration of the enclosed liquid media within two days. Carbon dioxide and oxygen are the only gases known to cause this deterioration. The gas barrier may be formed of saran or nylon material. The barrier is in the form of a sealed plastic bag which surrounds and encloses the inner bladder. The dispensing ports on the inner bladder may be accessed through the gas barrier by making a circular hole of $\frac{1}{4}$ to $\frac{1}{2}$ inch diameter in the gas barrier in the vicinity of the dispensing port to be accessed, then drawing the dispensing port through the circular hole. The spike at the end of the dispensing tube is then inserted into the dispensing port drawn through the circular hole in the gas barrier. Also the inner bladder may be removed from the gas barrier, thus allowing a one to two day usability period of the contained liquid media.

The present invention also comprises a cardboard box. The inner bladder, which is wrapped in the gas barrier in the preferred embodiment, is contained within the cardboard box. The frontal face of the cardboard box comprises a lid with flaps designed to be inserted into the box to strengthen the side walls of the box. The flap on the lid which is opposite the hinge is secured by a simple handle. This end flap has two holes which correspond to two holes in the end face of the box. The T-shaped ends of the simple handle are inserted through the holes in the end flap and the holes in the end face of the box. These T-shaped ends are then rotated 90 degrees to secure the box closed. The box may also be easily opened again by rotating the T-shaped ends of the handle 90 degrees to remove it, and to allow the end flap to be freed from the end face of the box.

In addition to the reinforcement provided by the flaps of the lid in the side walls of the box, additional reinforcement is provided to allow the box to support greater than 200 pounds. This reinforcement allows for several boxes to be stacked up on each other. The boxes should be stacked with the side walls vertical to support the other boxes. The stacking of the boxes greatly facilitates the storage of the present invention. The stackability also allows for the previously mentioned serial interconnection scheme to be implemented with very short interconnection jumper hoses. This is accomplished by stacking the boxes so the dispensing ports of the inner bladder are in close proximity to each other.

The box of the present invention also provides a means for viewing the enclosed inner bladder and media and for accessing the dispensing ports of the inner bladder. In the preferred embodiment, this means is in the form of two perforated cutouts. One is in the end side wall of the box opposite the handle, and the other is in the lid of the box. The inner bladder is situated in the box to orient the dispensing ports of the inner bladder in close proximity to the perforated cutout on the end side wall of the box opposite the handle. By removing this perforated cutout, the dispensing ports of the inner bladder may be conveniently accessed.

In the specific application of the preferred embodiment, the ability to view the contained aqueous nutrient solution or "liquid media" is very important. A color indicator may be added to the liquid media to indicate its usability. As previously mentioned, its usability may be affected by its exposure to various gases. The cutout provided on the top face or lid of the box is provided to facilitate viewing of the enclosed media without removing the inner bladder from the box. Removal of this cutout allows the user to visually inspect the enclosed liquid media and therefore determine its usability. The preferred embodiment contains two cutouts, one for viewing and the other for access to the dispensing ports of the inner bladder, for convenience, but it should be noted that a single cutout may be used for both purposes.

BRIEF DESCRIPTION OF THE DRAWINGS

The present invention is better understood with reference to the following description and the accompanying drawings.

DETAILED DESCRIPTION OF THE PREFERRED EMBODIMENTS

The present invention relates to a liquid container packaged in a box having a removable handle which acts as a closure device for the box.

Many types of liquids may be stored in the present invention such as: sterile fluids used in clinical applications; industrial enzymes packaged in glycerol for industrial processing applications; glucose solutions; sterile sugar solutions; protein solutions; blood; aqueous nutrient solutions for biological applications, otherwise known as liquid media (as opposed to powdered media); and similar liquids.

Figure 1:
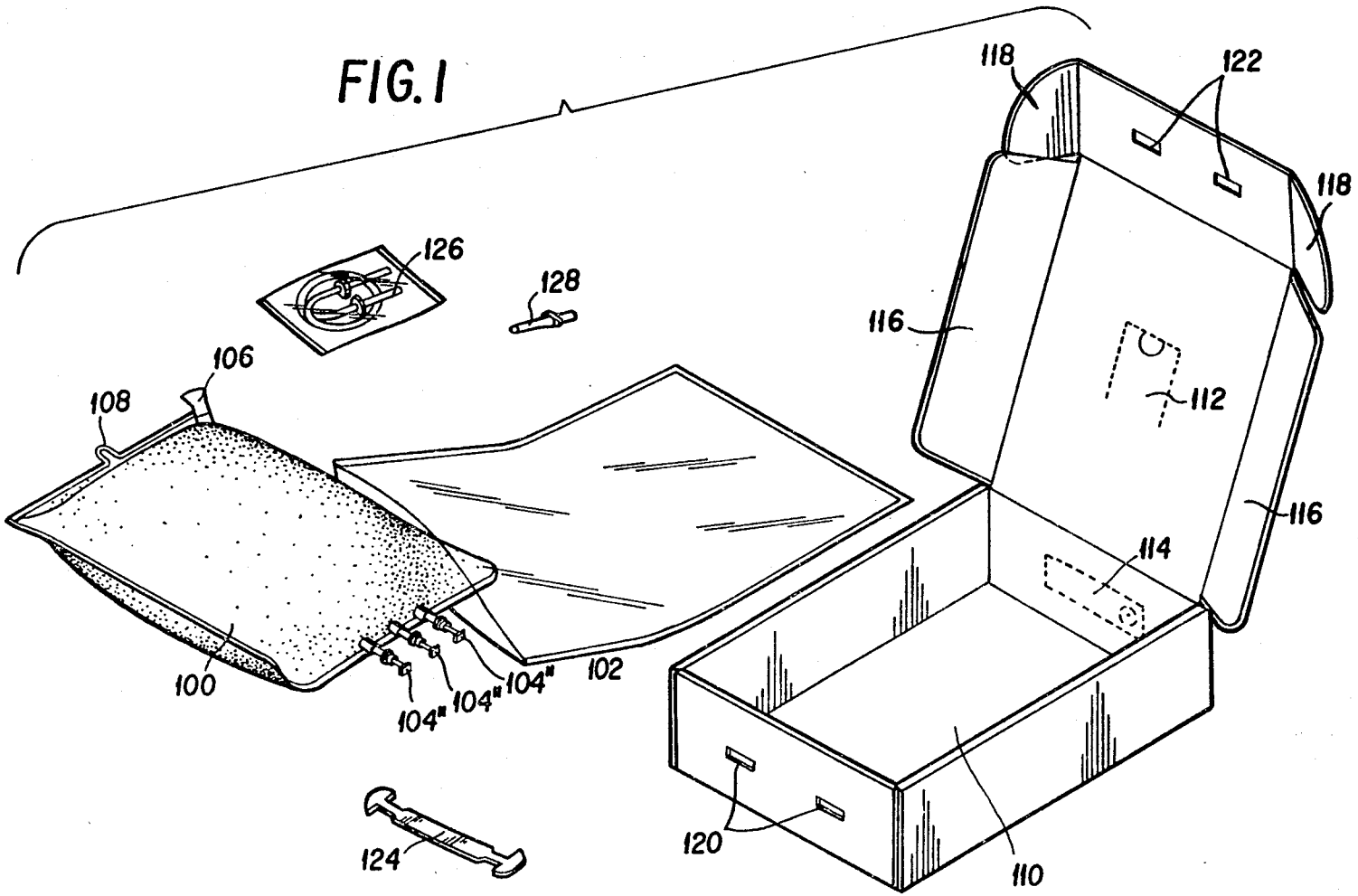
FIG. 1 is a view of the elements of the kit of the present invention exploded for clarity.
Figure 3:
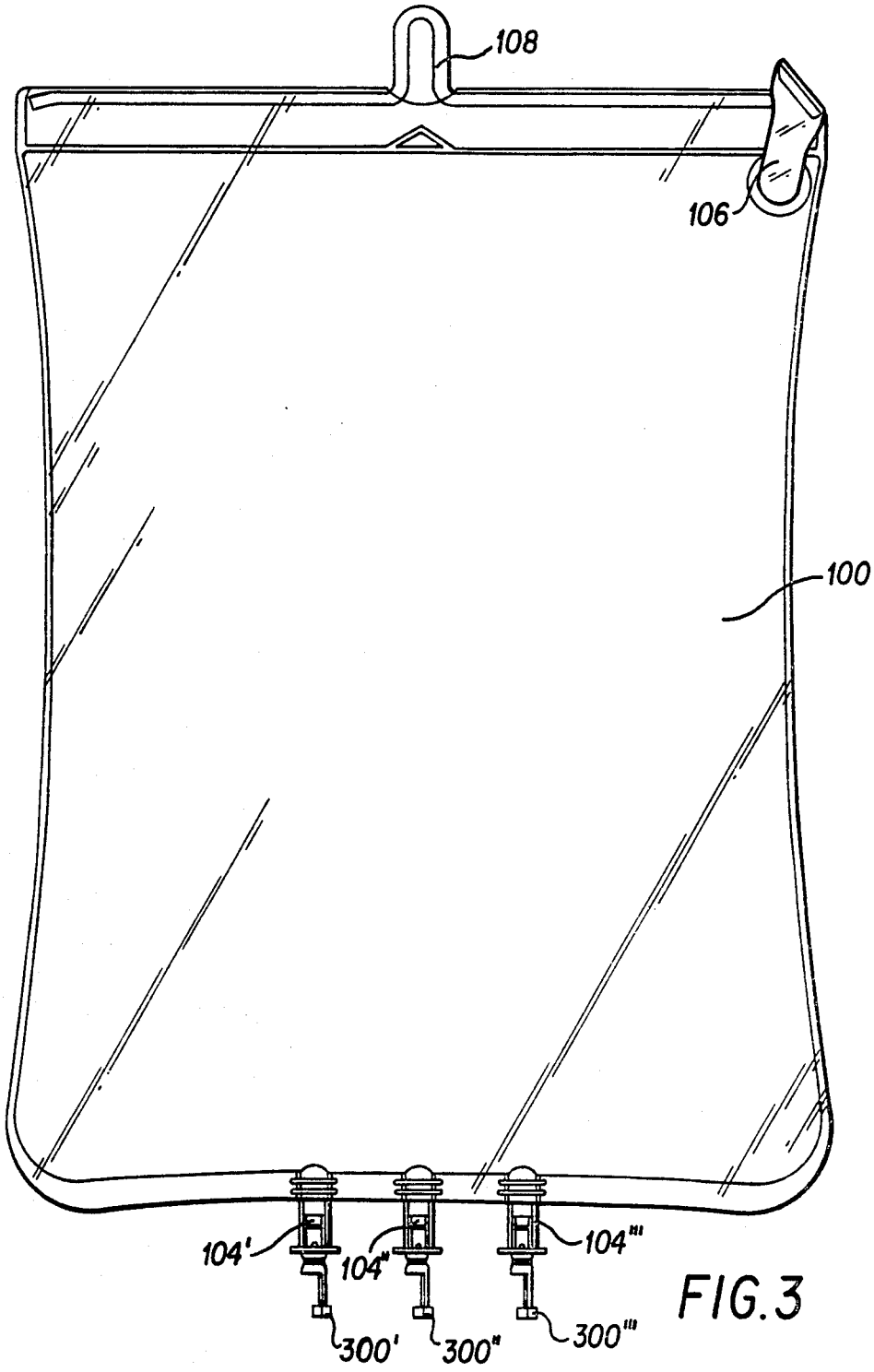
FIG. 3 is a top plan view of the inner bladder of the present invention.
Figure 4:
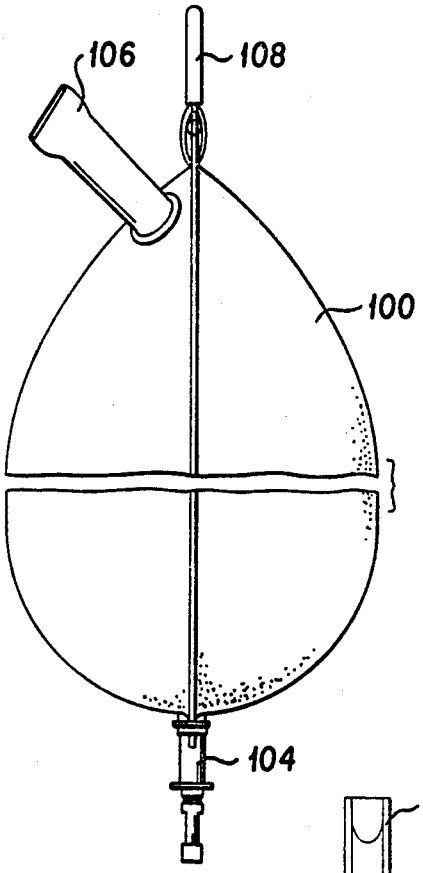
FIG. 4 is a right side view with a partial cutaway of the inner bladder of the present invention.

Referring now to FIGS. 1, 3 and 4, the present invention comprises an inner bladder 100 made of polyvinyl chloride which is wrapped in a $CO_2$ $O_2$ gas barrier 102. This gas barrier 102 may be in the form of a plastic bag. The gas barrier 102 reduces or prevents the deterioration of the liquid media in the inner bladder 100. The inner bladder 100 has three ports 104 for accessing the liquid. The ports are of a septum type, which can indicate tampering.

The inner bladder 100 also has a fill tube 106 for use in filling, and a metal bar 108 with a hook for hanging if the inner bladder 100 is removed from the box 110. The box 110 is designed to support weight sufficient to allow stacking of several boxes with associated filled inner bladders. The box 110 also has perforated cutouts 112 and 114 to allow viewing of the media and its color, and to provide access to the ports of the inner bladder stored in the box.

The liquid storage device for the present invention is the inner bladder 100. The inner bladder 100 in the preferred embodiment is comprised of two thin sheets of polyvinyl chloride plastic heat sealed at their edges to enclose a volume. FIG. 3 shows a top view of the inner bladder 100. Polyvinyl chloride is a strong, inexpensive, readily available and easily workable material, and it was chosen for those reasons.

A fill tube 106 is located in the upper right hand corner of the inner bladder 100 as shown in FIG. 3. The fill tube 106 can be a one quarter inch inside diameter polyvinyl chloride hose which is approximately four inches in length. This fill tube 106 is used to fill the empty inner bladder 100 with the liquid to be stored. After the inner bladder 100 has been filled, a solid plastic hose plug (not shown) is inserted into the end of the fill tube 106, and a clear heat shrink one inch diameter tube (not shown) is placed over the fill tube 106 and solid plastic hose plug. Another embodiment involves simply heat sealing the PVC fill tube closed and then placing the heat shrink tubing over the fill tube. The heat shrink tube is then shrunk to effectively seal the fill tube 106. Although the preferred embodiment may employ these specific methods of sealing the fill tube, any convenient method of effectively sealing the fill tube may be considered.

Another aspect of the inner bladder relates to the dispensing ports 104 located along the bottom edge of the inner bladder 100, as shown in FIG. 3. The preferred embodiment contains three hard plastic dispensing ports, 104', 104'', 104''', which are heat sealed into the bottom edge of the inner bladder 100 at the time the inner bladder 100 is formed. These dispensing ports comprise a pierceable septum (not shown), which acts as a sealing method to contain an enclosed liquid. The septum-type dispensing ports 104 are tamper-evident by the nature of septum-type devices.

Covering the dispensing ports are molded, tearaway sterile caps 300. These caps 300 are to protect the septum from inadvertent puncture and to insure sterility of the dispensing ports 104. These dispensing ports 104 are designed to be accessed with a mating spike which punctures the septum. This spike will be discussed later when the method of dispensing the contained liquid is discussed.

A hanging bar 108 is also heat sealed into the edge of the inner bladder 100 at the time the inner bladder 100 is formed. In the preferred embodiment, the hanging bar 108 is located on the opposite edge of the three dispensing ports 104, as seen in FIG. 3. The hanging bar 108 is, for example, a 0.18 inch metal bar which is formed with a hook in the center for hanging. The hanging bar 108 is designed to support a weight in excess of 20 pounds. Other aspects of the hanging of the inner bladder 100 will be discussed later in relation to the dispensing of the contained liquid.

Another aspect of the present invention relates to the gas barrier 102 as seen in FIG. 1. In the preferred embodiment it is in the form of a gas barrier 102 which surrounds the inner bladder 100 The preferred form of the gas barrier 102 consists of a plastic bag comprised of a thin film of saran or nylon plastic material. The purpose of the gas barrier 102 is to block the gases carbon dioxide ($CO_2$) and/or oxygen ($O_2$) from reacting with some contained liquids. Saran is the preferred material for constructing this gas barrier because saran exhibits better gas blocking characteristics than nylon although saran is more expensive than nylon. Both saran and nylon are easily workable and well suited for this gas blocking application. Note in FIG. 1 the gas barrier 102 is shown to have one end open to allow the insertion of the inner bladder 100. After the insertion of the inner bladder 100 into the gas barrier 102, however, the gas barrier 102 is sealed. The problem of accessing the dispensing ports 104 through the gas barrier 102 will be discussed in a later section dealing with the dispensing of the contained liquid.

The gas barrier 102 is essential in the specific application of the storage of an aqueous nutrient solution or "liquid media". Liquid media exhibits rapid deterioration when exposed to the gases carbon dioxide and/or oxygen. The inventors have discovered that the walls of the inner bladder 100, comprised of polyvinyl chloride, do not effectively block the permeation of the gases carbon dioxide and oxygen from the atmosphere to the contained liquid media. Without the gas barrier 102 enclosing the inner bladder 100, contained liquid media will deteriorate in a short amount of time (such as approximately two days) to an unusable state.

With regard to the deterioration of the contained liquid media, a color indicator may be added which changes color when the contained liquid media becomes unusable. In the specific application of storage of liquid media, the transparent polyvinyl chloride inner bladder and transparent saran or nylon gas barrier provide the user an easy means for determining the usability of the contained liquid media of a color indicator has been added.

Figure 2:
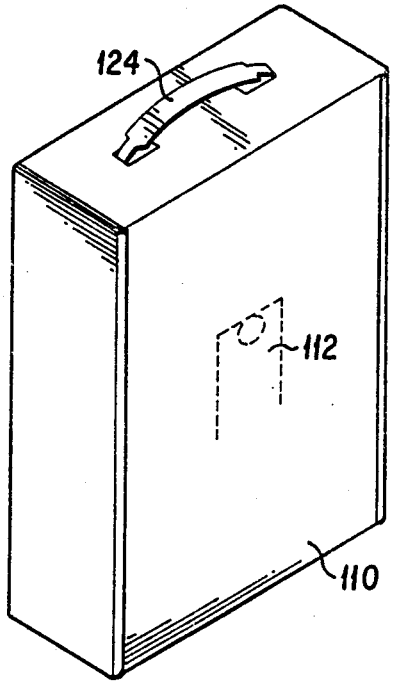
FIG. 2 is a perspective view of the closed box of the present invention containing the bladder (not shown) which contains the stored liquid.

The next major element of the present invention relates to the cardboard box 110, as seen in FIG. 1 in its opened form and in FIG. 2 in its closed form. As can be seen in the open box state in FIG. 1, the lid has four flaps 116 and 118, two located on the sides of the lid 116 and two located on the ends of the lid 118. The two flaps located along the sides of the lid 116 are designed to be placed in the interior of the box 100 along the side walls of the bottom section of the box 110. The outer side walls of the bottom of the box 110 are formed of two panels for reinforcement with a space in between them. The smaller two flaps located at the end section of the lid 118 are designed to be folded into the space formed between the two sections of the side walls of the bottom section of the box 110. With these two flaps 118 inserted into the space between the two panels of the side walls of the bottom section of the box 110, the end section of the lid lies flush against the end face of the bottom section of the box 110. As is clearly shown in Figure 1, the end face of the bottom section of the box 110 contains two rectangular holes 120. The end section of the lid of the box as contains two rectangular holes 122. In the closed position, these rectangular holes 120 and 122 are correctly aligned with each other.

The opening of the box 110 is accomplished by first lifting the end section of the lid away from the end section of the bottom part of the box 110, thus removing the two smaller flaps of the lid 118 from the space between the two panels of the side sections of the bottom part of the box 110. Once the two smaller flaps of the end section of the lid 118 are removed from the space between the two panels of the side section of the bottom part of the box 110, the lid may be lifted, thereby removing the longer pair of flaps on the sides of the lid 116 from the interior of the box 110.

As previously discussed, the two rectangular holes 120 in the end face of the lower section of the box 110 are designed to align themselves with the two rectangular holes 122 on the end section of the lid of the box 110 as seen in the picture of the open box 110 in FIG. 1. The handle 124, as also seen in FIG. 1, is comprised of flexible molded plastic. The handle 124 is flat with the ends formed into a semicircular T shape.

This handle 124 secures the box 110 closed in the following manner. With the box 110 in the closed form, as seen in FIG. 2, the T-shaped ends of the handle 124 are inserted lengthwise into the aligned rectangular holes 120 and 122 of the end face of the bottom portion of the box 110 and the end section of the lid. These T-shaped ends of the handle are then rotated 90 degrees, thereby inhibiting their removal from the rectangular holes 120 and 122.

With the handle 124 securely in place inserted into the rectangular holes 120 and 122, the end section of the lid of the box 110 is thereby secured to the end face of the lower portion of the box 110. This secures the lid in a closed position. The handle 124 provides a method for ease of carrying and handling of the box 100. By rotating the T-shaped ends of the handle 90 degrees and removing the handle 124 from the rectangular holes 120 and 124 in the end face of the closed box 110, the box 110 may be easily opened.

Another aspect of the cardboard box 110 of the present invention relates to the access and viewing of the contained liquid within the inner bladder 100 while the inner bladder 100 is in the box 110. The present invention comprises a single perforated cutout 114 in an outer wall of the cardboard box which allows the user to access the dispensing ports 104 of the inner bladder 100 and to view the contained liquid of the inner bladder 100.

The preferred embodiment contains two perforated cutouts 112 and 114 as seen in the the opened box depiction of FIG. 1. Located in the center of the lid of the open box in FIG. 1 and also shown in the center of the closed lid in FIG. 2 is a perforated cutout 112 which is perforated on three sides to allow a hinge type action. Also shown with this viewing cutout 112 is a thumb or finger hole to aid in the use of this viewing cutout 112. The necessity for this cutout 112, as previously discussed in the specific application of the containment and storage of liquid media, relates to the viewing of the contained liquid media. A user may wish to view contained liquid media to determine its color and therefore its usability as previously discussed in the section dealing with the deterioration of liquid media.

Figure 6:
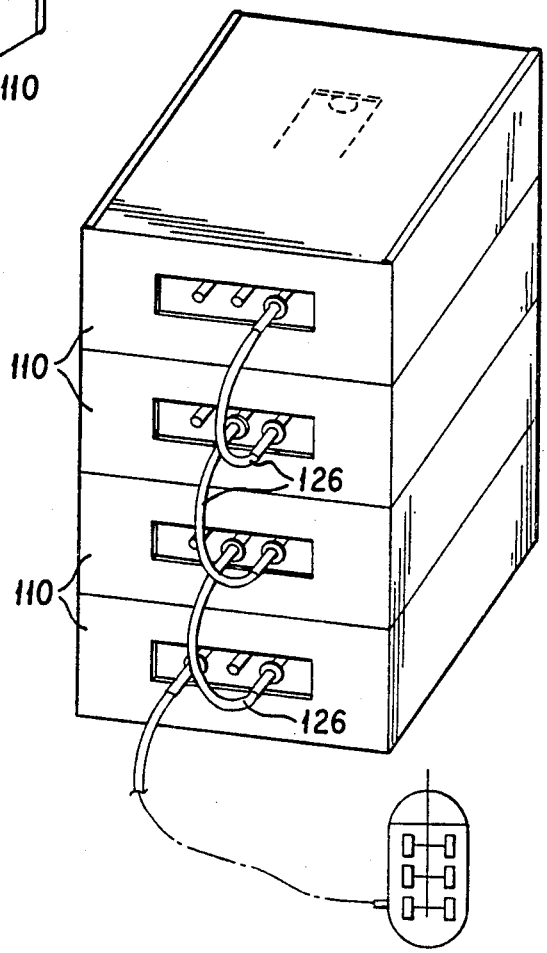
FIG. 6 is a perspective view of the assembly of several units of the present inventions showing 4 stacked boxes with their bladders serially interconnected with jumper hoses so as to provide a single output to the point of delivery.

In the preferred embodiment as shown in FIG. 1, there is a second perforated cutout 114 which is located on the end face of the lower portion of the box 110 opposite the end face containing the handle 124. This perforated cutout 114 is perforated on four sides and designed to be removed with the aid of the finger or thumb hole conveniently provided. The inner bladder 100 must be placed in the box 110 so the three dispensing port 104 are in close proximity to this access cutout 114 and the hanging bar 108 of the inner bladder 110 at the opposite end of the box 110 is in close proximity to the handle 124 of the box 110. With the inner bladder 100 so oriented, the removal of the access perforation 114 allows access to the dispensing ports 104 of the inner bladder 100 while the box 110 remains closed. A view of several boxes with the access perforations 114 removed showing convenient access to the dispensing ports 104 of the inner bladder 100 is seen in FIG. 6.

Another important aspect of the present invention relates to the stackability of the closed box 110. As previously mentioned in the section dealing with the side walls of the box 110, the side walls are comprised of two panels. With the box lid in the closed position, the flaps 116 of the lid act as an additional panel of the side walls of the box 110 and the end wall of the box 110 in which the handle 124 is located. The side walls of the box 110 consist of effectively three panels in the closed position. These three panels will allow the box 110 to support weights in excess of 200 pounds if properly positioned upon these side support walls. This is designed with the intent to allow stacking of several of these boxes with their associated filled inner bladders 100 to aid in the convenience of storage and dispensing which will be discussed later. A representative view of the stackability of the boxes in a dispensing setup is shown in FIG. 6.

Figure 5:
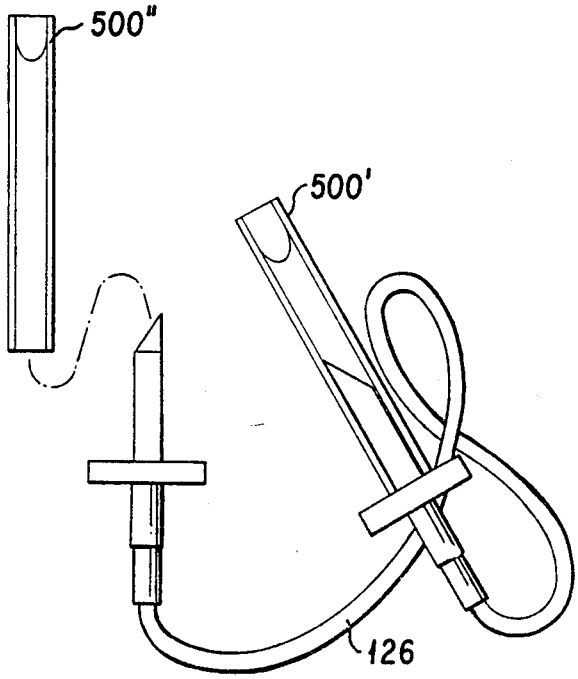
FIG. 5 is a perspective view of an interconnection jumper hose with one cap exploded for clarity for use in conjunction with the ports of the inner bladder of the present invention.

The present invention is also designed to facilitate various modes of dispensing of the liquid contained within the inner bladder 100. In introduction, the present invention kit comprises a serial interconnection jumper 126 which comprises a hose with a spike at each end, and a single spike 128 for use with a user supplied hose, as seen in the upper portion of FIG. 1. The spike 128 used in the kit are designed to mate with the dispensing ports 104 of the inner bladder 100 and securely seal the flowing liquid from leaking. The spikes are comprised of molded plastic and are hollow to allow the contained liquid in the inner bladder to flow through them into the adjoining hose. In the preferred embodiment, the jumper hose 126 comprises a $\frac{1}{8}$ inch in side diameter tube of flexible, clear polyvinyl chloride tubing. The spikes are covered with a cylindrical shaped hollow clear plastic cap 500. This cap is designed to protect and ensure the sterility of the spike. FIG. 5 shows a representative jumper hose 126 with one cap 500' covering a spike and the other exploded for clarity.

In the specific case of the storage of liquid media, the deterioration preventive $CO_2/O_2$ gas barrier 102 need not be removed or its seal broken to access the contained liquid. The present invention provides a method for inserting the spikes into the dispensing port 104 through the gas barrier 102 while still retaining the integrity of the gas barrier seal. This method is accomplished by making a circular hole of $\frac{1}{4}$ to $\frac{1}{2}$ inch diameter in the gas barrier 102 in the vicinity of the dispensing port to be accessed, then drawing the dispensing port 104 through the circular hole. The spike at the end of the dispensing tube is then inserted into the dispensing port 104 drawn through the circular hole in the gas barrier 102. This effectively retains the integrity of the seal of the gas barrier 102 while allowing access to the enclosed liquid of the inner bladder 100.

Also enclosed in the kit is a single molded plastic spike 128 in which the user must supply the delivery hose. In this fashion, the user may provide any length of hose necessary to deliver the contained fluid in the inner bladder 110 to the point of delivery.

Another aspect of the dispensing of liquid from the present invention relates to the orientation of the inner bladder 100. The inner bladder 100 may be left in the box 110 or removed from the box 110 for various dispensing applications as the user sees fit.

With the inner bladder 100 left in the box 110, the perforated access port 114 on the box 110 may be removed to conveniently access the dispensing ports 104 of the inner bladder 100. Another convenient feature of leaving the inner bladder 100 contained within the box 110 is the ability to stack several boxes upon one another due to the reinforcement of the side walls of the box 100 as previously discussed. The stackability of the boxes allows the user to have a greater supply of liquid readily available and in close proximity to his/her place of use. This eliminates the need for unnecessarily long supply hose runs as would be needed with nonstackable or scattered supply systems.

The inner bladder 100 may also be removed from the box 110 to facilitate dispensing if the user so desires. The inner bladder 100 may be laid flat for dispensing or the previously mentioned hanging bar 108 may be used to suspend the inner bladder 100. The inner bladder 100 may be hung to take advantage of a gravity flow dispensing method or simply for convenience such as where space is at a premium and hanging the inner bladder 100 may get it out of the way.

Another aspect of the present invention allows for various methods of interconnection schemes to be used in the dispensing of the contained liquid. The three dispensing ports 104 of the inner bladder 100 in the preferred embodiment are designed to be used as follows in a serial interconnection scheme: one dispensing port 104' is designed to act as an inlet from the preceding bladder; another dispensing port 104' is designed to act as an outlet to the next bladder; the third dispensing port 104'' is an optional port for additives or additional jumper distribution.

The advantage of serial interconnection is that it provides a theoretically unrestricted supply of the contained liquid. The preferred embodiment has an inner bladder 100 with an approximate volume of ten liters, but with serial interconnection the supply volume can be increased to 20 liters, 30 liters, 40 liters, and so on with the addition of more interconnected bladders in the serial chain. A representative view of a four-bladder serial interconnection chain with a supply tube leading from the last bladder in the serial chain to the point of delivery is seen in FIG. 6. A larger or smaller number of serially interconnected bladders may be easily envisioned.

An important aspect of the serial interconnection scheme is the jumper interconnection hose 126. This previously mentioned element of the kit is seen in FIG. 5 The preferred embodiment of this element comprises a six-inch long PVC hose ⅛ inch in diameter with spikes at each end. Six inch interconnection jumpers 126 are designed to be used in an interconnection scheme in which the dispensing ports 104 of each inner bladder 100 are in close proximity as when the boxes 110 containing the inner bladders 100 are stacked as seen in FIG. 6. If the user desires not to have the dispensing ports 104 of the inner bladders 110 in close proximity, a longer interconnection jumper hose may be envisioned.

Figure 7:
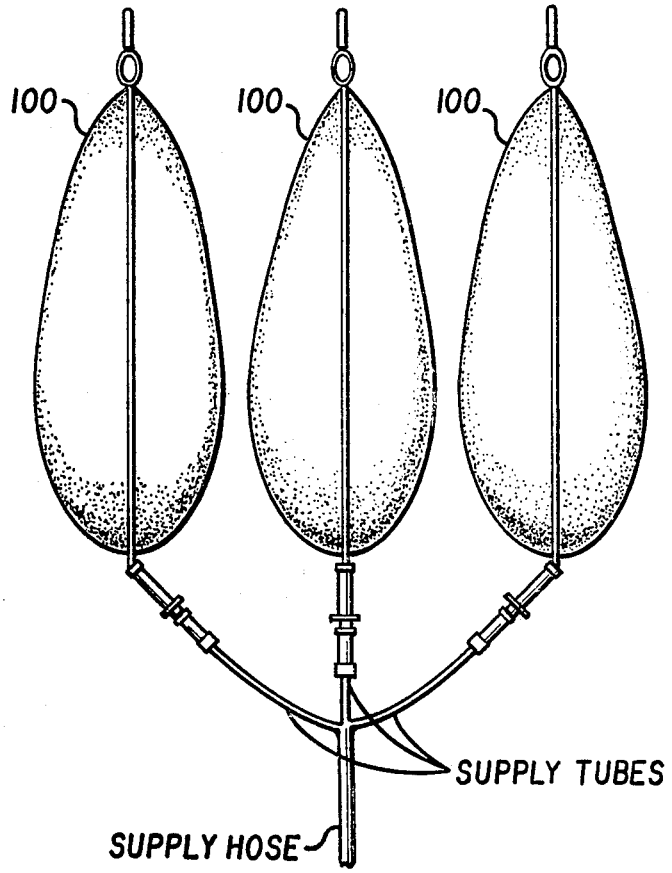
FIG. 7 illustrates a parallel interconnection scheme in which a supply tube from each inner bladder is brought to a single point and consolidated into a single supply hose and then taken to the point of delivery.

Other interconnection schemes for example, is illustrated in FIG. 7, may also be considered. A parallel interconnection scheme in which a supply tube from each inner bladder 100 is brought to a single point and consolidated into a single supply hose and then taken to the point of delivery. Any combination of these two interconnection schemes may also be considered depending upon the needs and wishes of the user.

It should be understood that the foregoing embodiments are representations of the present invention, and the full extent of the present invention is defined by the following claims.

We claim:

1. A system adapted to store and deliver a liquid, which comprises:

(1) a first unit comprising:
- (a) a first box having a lid and a bottom section, said first box being closed when said lid is mated with said bottom section;
- (b) first handle means for keeping said lid mated with said bottom section;
- (c) a first inner bladder disposed in said first box and having an enclosed volume for storing the liquid;
- (d) first dispensing means comprising at least first and second dispensing ports, connected to said first inner bladder for dispensing the liquid in said enclosed volume; and
- (e) first gas barrier means for enclosing said first inner bladder and said first dispensing means for substantially reducing the flow of $CO_2$ or $O_2$ from the environment to the liquid in said enclosed volume;

(2) a second unit comprising:
- (a) a second box having a lid and a bottom section, said second box being closed when said lid is mated with said bottom section;
- (b) second handle means for keeping said lid mated with said bottom section;
- (c) a second inner bladder disposed in said second box and having an enclosed volume for storing the liquid;
- (d) second dispensing means comprising at least first and second dispensing ports, connected to said second inner bladder for dispensing the liquid in said enclosed volume; and
- (e) second gas barrier means for enclosing said second inner bladder and said second dispensing means for substantially reducing the flow of $CO_2$ or $O_2$ from the environment to the liquid in said enclosed volume;

(3) a third unit comprising:
- (a) a third box having a lid and a bottom section, said third box being closed when said lid is mated with said bottom section;
- (b) third handle means for keeping said lid mated with said bottom section;
- (c) a third inner bladder disposed in said third box and having an enclosed volume for storing the liquid;
- (d) third dispensing means comprising at least first and second dispensing ports, connected to said third inner bladder for dispensing the liquid in said enclosed volume; and (e) third gas barrier means for enclosing said third inner bladder and said third dispensing means for substantially reducing the flow of $CO_2$ or $O_2$ from the environment to the liquid in said enclosed volume; and (4) interconnection means for fluid interconnection of said first, second, and third dispensing means, in which said second port of said first unit is connected to said first port of said second unit, and in which said second port of said second unit is connected to said first port of said third unit.

2. The system of claim 1, wherein said interconnection means comprises means for connecting in series the liquid in said enclosed volume of said first inner bladder with the liquid in said enclosed volume of said second inner bladder.

3. The system of claim 1, wherein said interconnection means comprises means for connecting in parallel the liquid in said enclosed volume of said first inner bladder with the liquid in said enclosed volume of said second inner bladder.

* * * * *